US007777420B2

(12) United States Patent
Jeon et al.

(10) Patent No.: US 7,777,420 B2
(45) Date of Patent: Aug. 17, 2010

(54) ELECTRON EMISSION DEVICE

(75) Inventors: Sang-Ho Jeon, Suwon-si (KR); Byong-Gon Lee, Suwon-si (KR); Sang-Jo Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1190 days.

(21) Appl. No.: 11/347,329

(22) Filed: Feb. 3, 2006

(65) Prior Publication Data

US 2006/0186821 A1 Aug. 24, 2006

(30) Foreign Application Priority Data

Feb. 24, 2005 (KR) ..... 10-2005-0015310

(51) Int. Cl.
*G09G 3/10* (2006.01)
*H01J 1/62* (2006.01)

(52) U.S. Cl. ..... 315/169.1; 313/505; 313/584

(58) Field of Classification Search ... 315/169.1–169.4; 313/495, 496, 498, 505, 506, 582–585; 345/55, 345/76, 82, 206, 698

See application file for complete search history.

(56) References Cited

U.S. PATENT DOCUMENTS

| | | | | |
|---|---|---|---|---|
| 6,376,995 | B1 * | 4/2002 | Kato et al. | 315/169.3 |
| 6,614,177 | B2 * | 9/2003 | Kanno et al. | 313/506 |
| 6,717,352 | B2 * | 4/2004 | Hirasawa et al. | 313/496 |
| 7,164,394 | B2 * | 1/2007 | Hirose et al. | 345/60 |
| 7,319,292 | B2 * | 1/2008 | Choi et al. | 313/587 |

* cited by examiner

*Primary Examiner*—Douglas W Owens
*Assistant Examiner*—Jimmy T Vu
(74) *Attorney, Agent, or Firm*—Christie, Parker & Hale, LLP

(57) ABSTRACT

An electron emission device includes a first substrate, a second substrate facing the first substrate, a scan electrode formed on the first substrate and having a width Sv, and a data electrode formed on the first substrate perpendicular to and crossing the scan electrode at a crossed region. A unit pixel is disposed in an area of the crossed region and has a pitch Pv. An insulating layer is disposed between the scan electrodes and the data electrodes. An electron emission region is electrically coupled the scan electrode or the data electrode, and the scan electrode and the unit pixel satisfy the following condition: $0.5 \leqq Sv/Pv \leqq 0.95$.

11 Claims, 5 Drawing Sheets

ELECTRON EMISSION DEVICE

CROSS REFERENCE TO RELATED APPLICATION

This application claims priority to and the benefit of Korean Patent Application No. 10-2005-0015310 filed on Feb. 24, 2005 in the Korean Intellectual Property Office, the entire content of which is incorporated herein by reference.

BACKGROUND OF THE INVENTION

1. Field of the Invention

The present invention relates to an electron emission device, and in particular, to an electron emission device which has scan and data electrodes for controlling the emission of electrons from electron emission regions.

2. Description of Related Art

Generally, electron emission devices are classified into those using hot cathodes as an electron emission source, and those using cold cathodes as an electron emission source. There are several types of cold cathode electron emission devices, including a field emitter array (FEA) type, a metal-insulator-metal (MIM) type, a metal-insulator-semiconductor (MIS) type, and a surface conduction emitter (SCE) type.

An FEA type electron emission device is based on the principle that when a material having a low work function or a high aspect ratio is used as the electron emission source, electrons are easily emitted from the electron emission source when an electric field is applied thereto under the vacuum atmosphere. A sharp-pointed tip structure based on molybdenum (Mo) or silicon (Si), or a carbonaceous material such as graphite has been applied for making the electron emission regions.

In a common FEA type electron emission device, cathode and gate electrodes are arranged on a first substrate perpendicular to each other in an insulating manner, and electron emission regions are provided on the cathode electrodes at the respective crossed unit pixel regions thereof with the gate electrodes. Phosphor layers and an anode electrode are formed on a surface of a second substrate facing the first substrate.

One of the cathode and the gate electrodes functions as a scan electrode, and the other electrode functions as a data electrode for carrying image data. The anode electrode receives a high voltage (a direct current voltage of several hundred to several thousand volts) required for accelerating the electron beams, and keeps the phosphor layers in a high potential state.

When scan signals are sequentially applied to the scan electrodes, and data signals are selectively applied to the data electrodes corresponding to the selected scan electrodes, electric fields are formed around the electron emission regions at the unit pixels where the voltage difference between the two electrodes exceeds a threshold value, and electrons are emitted from those electron emission regions. The emitted electrons are attracted by the high voltage applied to the anode electrode, and collide against the corresponding phosphor layers to thereby light-emit them.

The scan electrode is commonly formed with a metallic layer having a thickness of several thousand angstroms (1 Å=$10^{-10}$ m), and receives a voltage of about 80V-120V during the driving of the electron emission device. When an electric current is applied to the scan electrode, heat is generated at the scan electrode due to the internal resistance thereof. Moreover, the scan voltage is applied as a rectangular wave pulse. The rectangular wave pulse has an advantage of uniformly causing emission of electrons from the electron emission regions, but it induces a temperature elevation at the scan electrode. This temperature elevation is due to the peak value of the instantaneous current increasing due to the instantaneous voltage application.

The generated heat deteriorates the scan electrode, and in a serious case, the scan electrode can become partially burnt out, and cut. The cutting of the scan electrode causes image distortion during the driving of the electron emission device.

To address this problem, it has been proposed that the scan driving pulse should be distorted to lower the peak value of the instantaneous electric current. Although this may reduce the heat generated at the scan electrode, a serious luminance difference may result between the left and the right sides of the screen, corresponding to both ends of the scan electrode during the driving of the electron emission device, thereby deteriorating the display quality.

SUMMARY OF THE INVENTION

In one exemplary embodiment of the present invention, an electron emission device reduces the heat generated at the scan electrode without distorting the scan driving pulse to thereby prevent the electrode breakage due to the temperature elevation, and enhances the display quality.

An electron emission device includes a first substrate, a second substrate facing the first substrate, a scan electrode formed on the first substrate and having a width Sv, and a data electrode formed on the first substrate perpendicular to and crossing the scan electrode at a crossed region. A unit pixel is defined in an area of the crossed region and has a pitch Pv. An insulating layer is disposed between the scan electrode and the data electrode. An electron emission region is electrically coupled to the scan electrode or the data electrode, and the scan electrode and the unit pixel satisfy the following condition: $0.5 \leqq Sv/Pv \leqq 0.95$. In one embodiment, the scan electrode and the unit pixel satisfy the following condition: $0.79 \leqq Sv/Pv \leqq 0.95$.

An area of the scan electrode within the unit pixel in one embodiment is 50% or more of an area of the unit pixel, and the scan electrode is arranged along a long axis of the first and the second substrates. In one embodiment, the pitch of the unit pixel is a vertical pitch measured in a direction of a width of the scan electrode.

The data electrode, the insulating layer and the scan electrode may be sequentially formed on the first substrate. In one embodiment, the electron emission region may be electrically coupled to the data electrode. In this case, an opening is formed at the scan electrode and the insulating layer while partially exposing the surface of the data electrode, and the electron emission region is formed on the data electrode within the opening.

In another embodiment, the electron emission region may be electrically coupled to the scan electrode. In this case, the electron emission region contacts a lateral surface of the scan electrode, and is placed on the insulating layer. A counter electrode may be further formed to be electrically coupled to the data electrode.

The scan electrodes may be with a metallic layer having a thickness of 0.1~0.3 μm, and a specific resistance of 0.1~100 Ωcm.

A scan electrode may be used in an electron emission device that has a unit pixel with a pitch Pv. The scan electrode has a width Sv satisfying the following condition: $0.5\ Pv \leqq Sv \leqq 0.95\ Pv$. In one embodiment, the scan electrode the width of the scan electrode satisfies the following condition: $0.79\ Pv \leqq Sv \leqq 0.95\ Pv$. An area of the scan electrode to be disposed within the unit pixel may be 50% or more of the area of the unit pixel, and the pitch of the unit pixel may be a vertical pitch.

In one embodiment, the scan electrode also includes an opening to be disposed within an area of the unit pixel. The scan electrode may include a metallic layer having a thickness of approximately 0.1~0.3 μm, or a specific resistance of approximately 0.1~100 Ωcm.

DETAILED DESCRIPTION

An electron emission device according to an embodiment of the present invention will be now explained.

Figure 1:
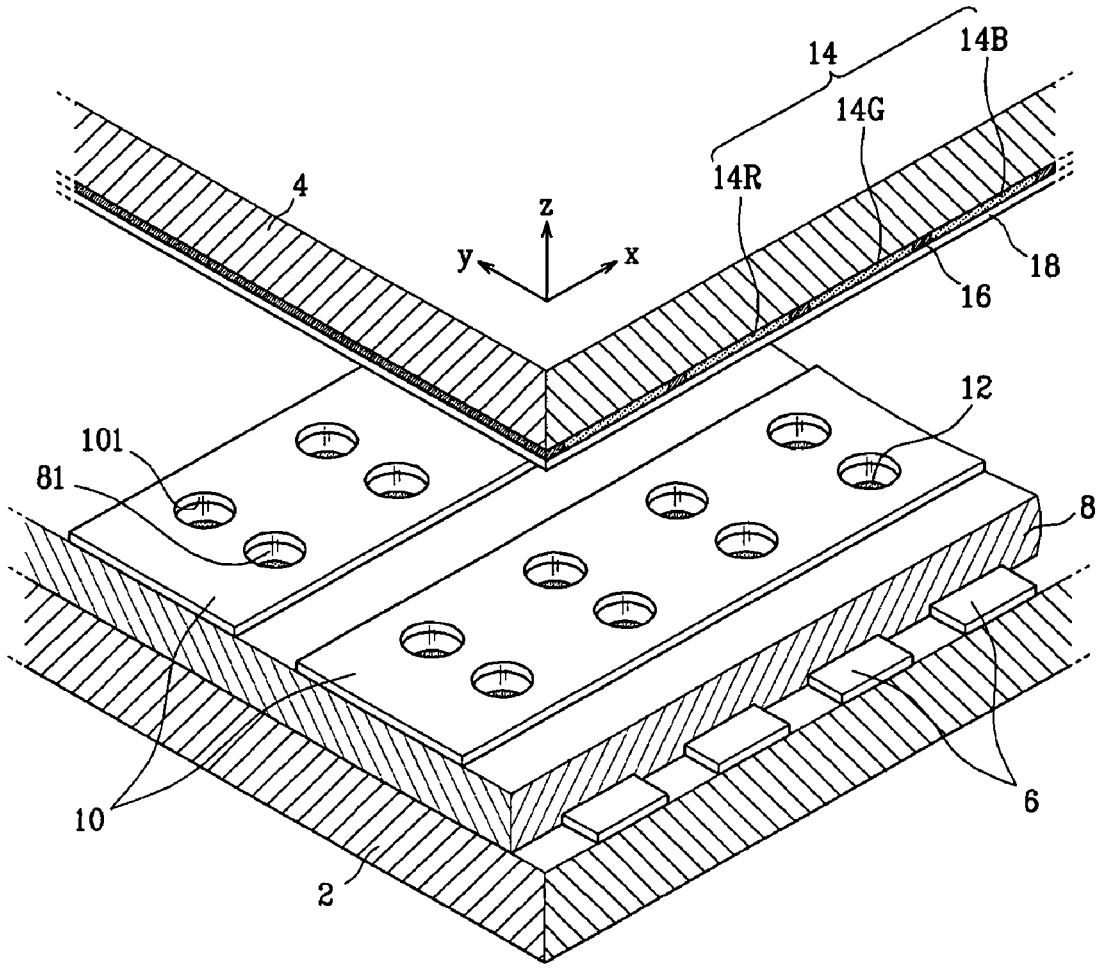
FIG. 1 is a partial exploded perspective view of an electron emission device according to an embodiment of the present invention.
Figure 2:
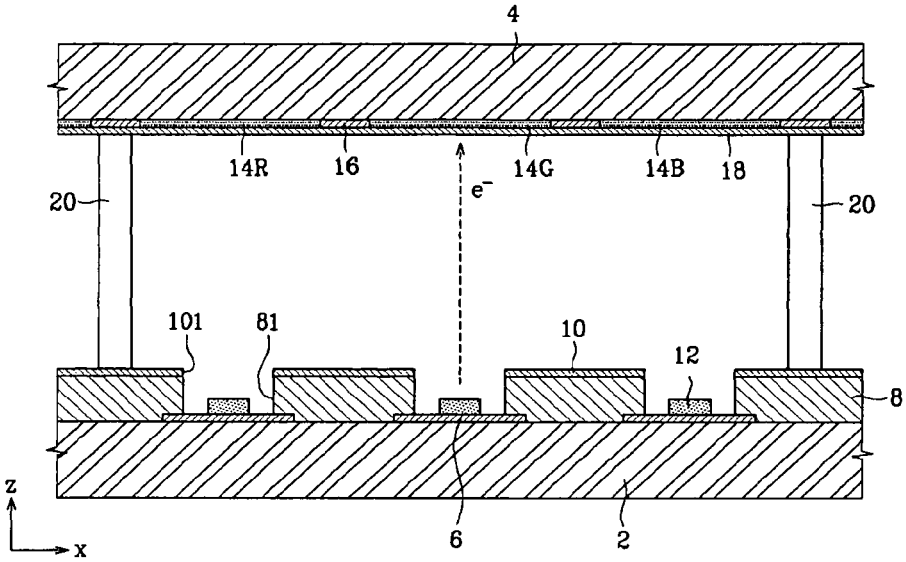
FIG. 2 is a partial sectional view of the embodiment shown in FIG. 1.
Figure 3:
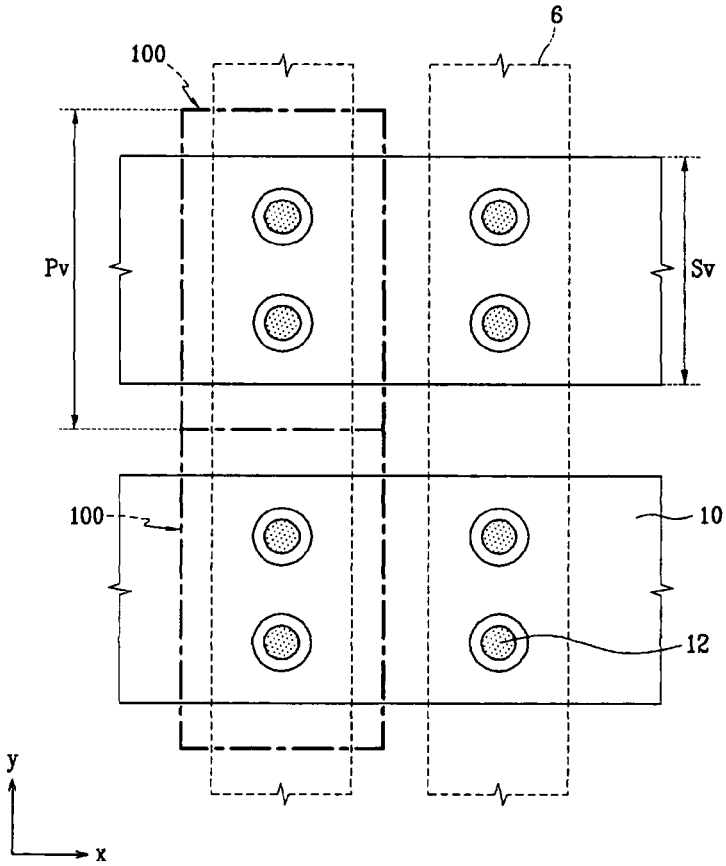
FIG. 3 is a partial plan view of the embodiment shown in FIGS. 1 and 2.

As shown in FIGS. 1 to 3, the electron emission device includes first and second substrates 2 and 4 arranged parallel to each other and spaced apart by a predetermined distance. A sealing member (not shown) is provided at the peripheries of the first and the second substrates 2 and 4, thereby forming a vacuum inner space in association with the two substrates. That is, the first and the second substrates 2 and 4, and the sealing member form a vacuum vessel.

In the embodiment shown, cathode electrodes 6 are stripe-patterned on the first substrate 2 in a first direction, and an insulating layer 8 is formed on substantially the entire surface of the first substrate 2 and covers the cathode electrodes 6. Gate electrodes 10 are stripe-patterned on the insulating layer 8 perpendicular to the cathode electrodes 6 to cross in crossed regions.

The crossed regions of the cathode and the gate electrodes 6 and 10 on the first substrate 2 are disposed at unit pixels 100 defined on the first substrate 2 (shown in FIG. 3). Openings 81 and 101 are formed in the insulating layer 8 and the gate electrodes 10 at the crossed regions of the cathode and the gate electrodes 6 and 10, while partially exposing the surface of the cathode electrodes 6. Electron emission regions 12 are formed on the cathode electrodes 6 within the openings 81 and 101.

The unit pixel 100 corresponds to any one-colored phosphor layer among the red, green and blue phosphor layers 14R, 14G and 14B, and three unit pixels 100 corresponding to the three-colored phosphor layers 14R, 14G and 14B collectively form a pixel.

In this embodiment, the electron emission regions 12 are formed as a material emitting electrons under the application of an electric field in a vacuum atmosphere, such as a carbonaceous material, or a nanometer-sized material. The electron emission regions 12 may be formed with, for example, carbon nanotube, graphite, graphite nanofiber, diamond, diamond-like carbon, $C_{60}$, silicon nanowire or a combination thereof, by way of, for example, screen-printing, direct growth, chemical vapor deposition, or sputtering.

The electron emission regions 12 may be formed with a sharp-pointed tip structure having molybdenum (Mo) or silicon (Si). The number of electron emission regions 12 placed at a unit pixel 100, and the shape of the openings 81 and 101 may vary, and are not limited to the numbers and shapes illustrated.

Red, green and blue phosphor layers 14R, 14G and 14B are arranged on a surface of the second substrate 4 facing the first substrate 2 and separated by a particular distance, and black layers 16 are disposed between the respective phosphor layers 14 to enhance the screen contrast.

An anode electrode 18 is formed on the phosphor layers 14 and the black layers 16 and includes a metallic material, such as aluminum Al. The anode electrode 18 receives a voltage required for accelerating the electron beams (a direct current voltage of several hundred to several thousand volts), and reflects the visible rays radiated from the phosphor layers 14, thereby increasing the screen luminance.

Alternatively, an anode electrode may be first formed on a surface of the second substrate, and phosphor layers and black layers can then be formed on the anode electrode. In this case, the anode electrode is formed with a transparent conductive material such as indium tin oxide (ITO) such that it transmits the visible rays radiated from the phosphor layers.

As shown in FIG. 2, a plurality of spacers 20 are arranged between the first and the second substrates 2 and 4 to maintain the distance between the two substrates 2 and 4, and to add support against pressure applied to the vacuum vessel to prevent the breakage of the vacuum vessel. The spacers 20 are located in the area of the black layers 16 such that they do not occupy the area of the phosphor layers 14. In this embodiment, the gate electrodes 10 can function as scan electrodes, and the cathode electrodes 6 can function as data electrodes for carrying the image data.

Figure 4:
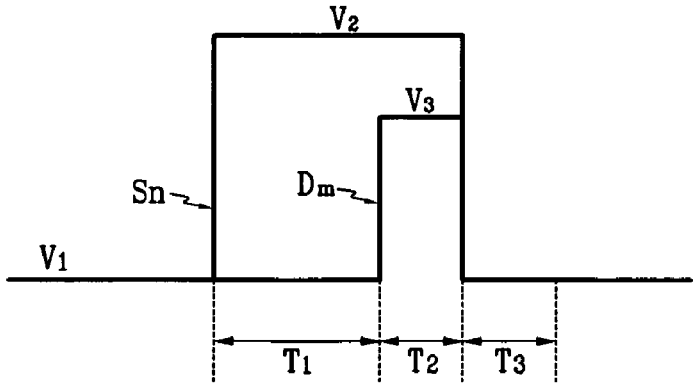
FIG. 4 is a driving waveform diagram illustrating waveforms of scan and data voltages applied in an electron emission device according to one embodiment of the present invention.

FIG. 4 is a driving waveform diagram illustrating the waveforms of scan and data voltages applied in an electron emission device. For explanatory convenience, the gate electrodes 10 will be referred to hereinafter as the "scan electrodes," and the cathode electrodes 6 will be referred to as the "data electrodes."

As shown in FIG. 4, an ON voltage $V_2$ of the scan signal is applied to the scan electrode Sn during the period $T_1$, and an ON voltage $V_1$ of the data signal is applied to the data electrode Dm. Then, electrons are emitted from the electron emission regions due to the difference $V_2-V_1$ between the voltages applied to the scan electrode Sn and the data electrode Dm. The emitted electrons collide against the phosphor layers, causing them to emit light.

Thereafter, the ON voltage $V_2$ of the scan signal is maintained at the scan electrode Sn during the period $T_2$, and an OFF voltage $V_3$ of the data signal is applied to the data electrode Dm. Then, the difference $V_2-V_3$ between the voltages applied to the scan electrode Sn and the data electrode Dm is reduced, and hence, the electrons are not emitted from the electron emission regions. The time interval $T_1$ during which the data pulse is maintained may be varied to thereby express the desired gray scales.

An OFF voltage $V_1$ of the scan signal is applied to the scan electrode Sn during the period $T_3$, and an OFF voltage $V_1$ of the data signal is applied to the data electrode Dm. Therefore, electrons are not emitted from the electron emission regions. The OFF voltage $V_1$ of the scan signal is established to be the same as the ON voltage $V_1$ of the data signal, which is commonly 0V. The ON voltage $V_2$ of the scan signal may be established to be in the range of 80~120V.

The scan electrodes are arranged in a horizontal direction of the display area (not shown) for displaying the screen images. The horizontal direction is in the direction of the long axis of the first and the second substrates 2 and 4 (in the direction of the x axis in FIGS. 1-3). The scan electrodes are formed with a metallic layer having a specific resistance of approximately 0.1~100 Ωcm and a thickness of approximately 0.1~0.3 μm, such that the internal resistance thereof can be reduced.

Referring to the embodiment shown in FIG. 3, the scan electrode 10 satisfies the following condition (Formula 1):

$$0.5 \leqq Sv/Pv \leqq 0.95,$$

when the width of the scan electrode 10 is indicated by Sv, and the pitch of the unit pixels 100 measured along the width of the scan electrode (in the direction of the y axis of the drawing) is indicated by Pv. In one embodiment, the pitch is a vertical pitch.

Electron emission devices were fabricated according to several Examples (Ex.) where the value of Sv/Pv satisfied the condition of Formula 1, and Comparative Examples (Com. Ex.) where the value of Sv/Pv deviated from the condition of Formula 1. For each of the Examples and Comparative Examples, the electron emission devices were driven and damage to the scan electrodes was observed. The results are listed in Table 1, below.

With all of the Examples and Comparative Examples tested, the vertical pitch Pv of the unit pixel was 632 μm, and the degree of breakage of the scan electrodes was observed after the voltages of 100V and 0V had been applied to the scan electrodes and the data electrodes for five (5) hours. The degree of damage to the scan electrodes are indicated by ◎, ○, Δ, and X in sequence from the lowest to the highest degree of damage.

TABLE 1

| | Com. Ex. 1 | Com. Ex. 2 | Com. Ex. 3 | Com. Ex. 4 | Ex. 1 | Ex. 2 | Ex. 3 | Ex. 4 |
|---|---|---|---|---|---|---|---|---|
| Sv (μm) | 150 | 200 | 250 | 300 | 350 | 400 | 500 | 600 |
| Sv/Pv | 0.237 | 0.316 | 0.400 | 0.475 | 0.554 | 0.632 | 0.791 | 0.949 |
| Damage to scan electrode | X | X | X | Δ | ○ | ○ | ◎ | ◎ |

As listed in Table 1, in the electron emission devices according to the Comparative Examples, where the ratio of the width Sv of the scan electrode to the vertical pitch Pv of the unit pixel was less than 0.5, the heat generated at the scan electrode was increased, and the scan electrode was seriously damaged. In contrast, in the electron emission devices according to the Examples, where the ratio of the width Sv of the scan electrode to the vertical pitch Pv of the unit pixel was 0.5 or more, the heat generated at the scan electrode was reduced, and hence, the scan electrode had little damage.

Moreover, in the electron emission devices according to the Examples 3 and 4, where the ratio of the width Sv of the scan electrode to the vertical pitch Pv of the unit pixel exceeded 0.79, the scan electrode showed the least damage. Accordingly, the ratio of the width Sv of the scan electrode to the vertical pitch Pv of the unit pixel in some embodiments of the invention is established to be in the range of 0.79~0.95.

In the electron emission devices according to the Comparative Examples where the scan electrode had a narrow line width, upon receipt of the scan voltage with the waveform shown in FIG. 4, the elevation of the peak value in the momentary electric current raised the temperature in the scan electrode, thereby inducing the breakage of the electrode due to the generated heat. In contrast, in the electron emission devices according to the Examples, although the peak value in the momentary electric current was elevated, the line width of the scan electrode was enlarged so that the internal resistance was lowered, and hence, the heat generation at the scan electrode was minimized.

Meanwhile, when the ratio of the width Sv of the scan electrode 10 to the vertical pitch Pv of the unit pixel 100 exceeds 0.95, the marginal space between the neighboring scan electrodes 10 becomes short of so that a driving interference may be made between the unit pixels 100, or an electrical short may be made between the neighboring scan electrodes. Therefore, the ratio of Sv/Pv in some embodiments is established to be 0.95 or less.

When the area of the unit pixel 100 and the area of the scan electrode 10 within the unit pixel 100 are compared with each other based on the ratio of Sv/Pv, the area of the scan electrode 10 within the unit pixel 100 is established in some embodiments to be 50% or more of the area of the unit pixel 100.

An electron emission device according to another embodiment of the present invention will be now explained.

Figure 5:
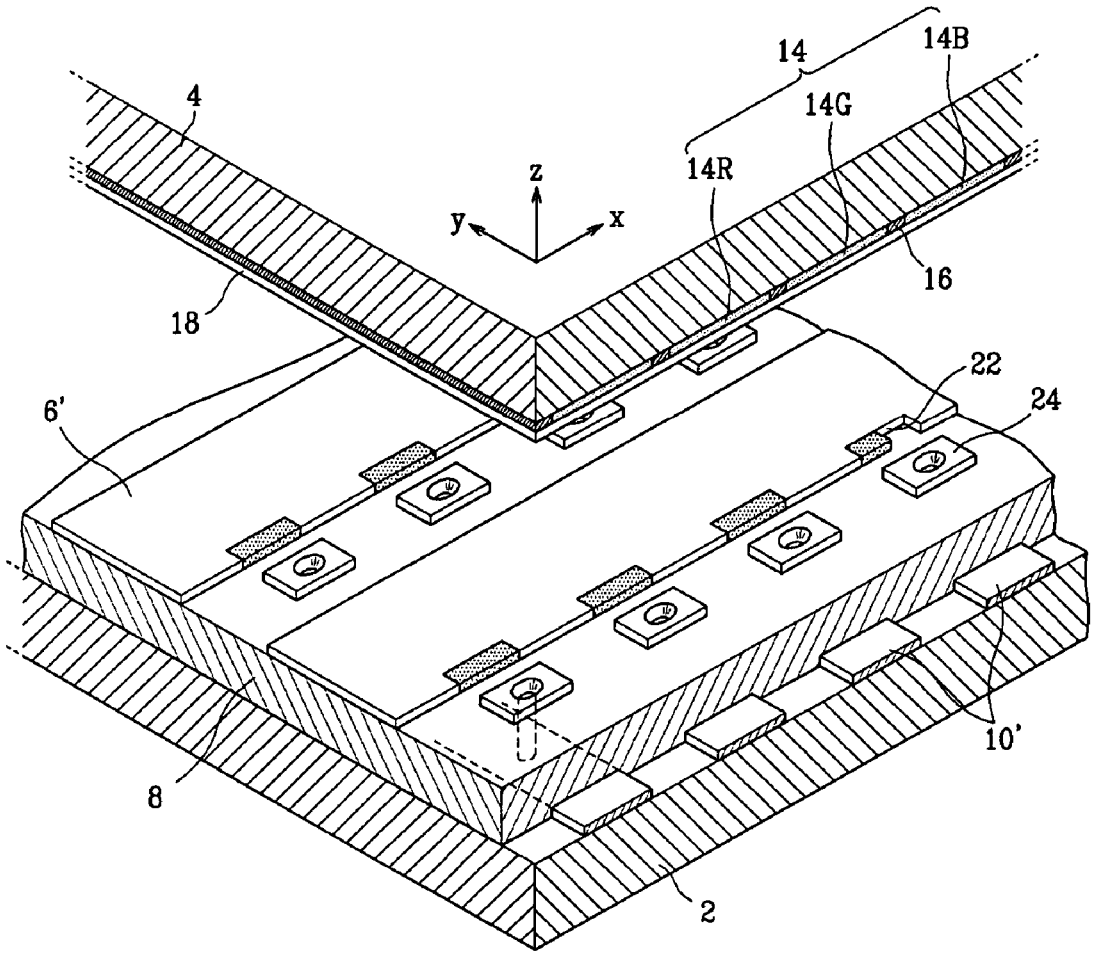
FIG. 5 is a partial exploded perspective view of an electron emission device according to another embodiment of the present invention.
Figure 6:
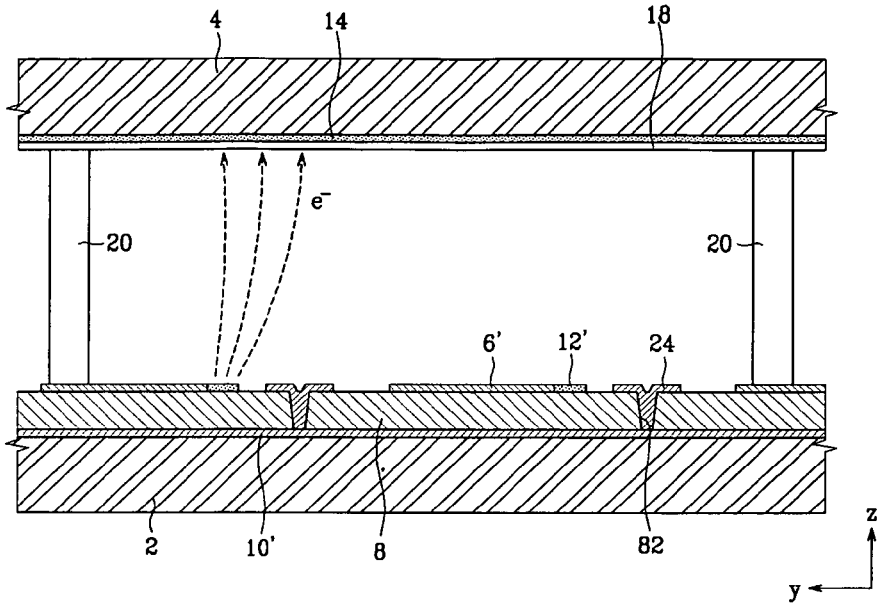
FIG. 6 is a partial sectional view of the embodiment shown in FIG. 5.
Figure 7:
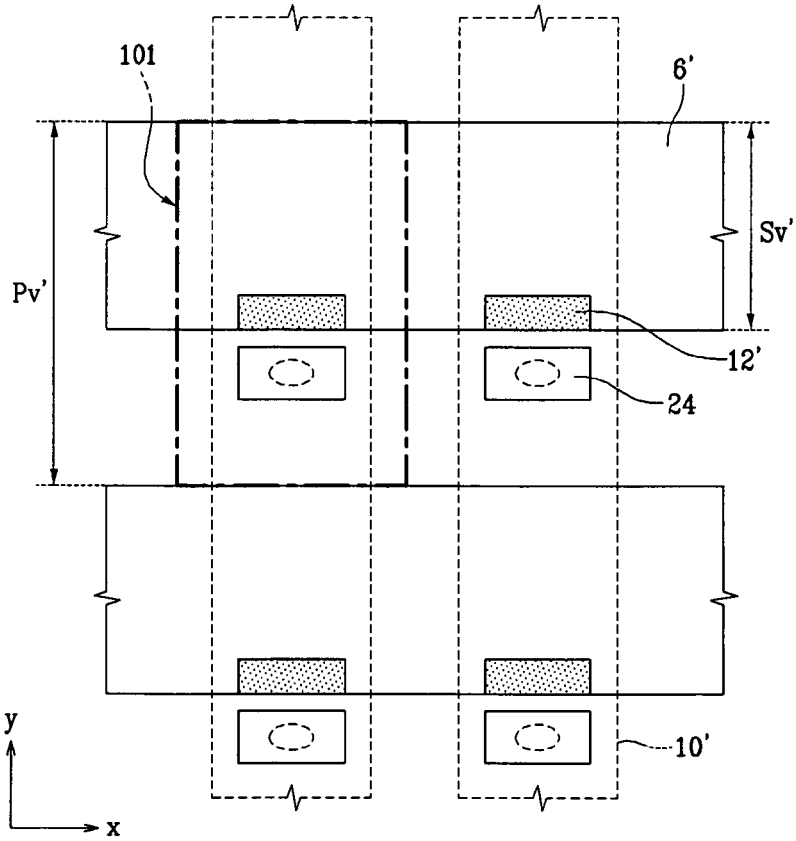
FIG. 7 is a partial plan view of the embodiment shown in FIGS. 5 and 6.

As shown in FIGS. 5 to 7, the gate electrodes 10' are first formed on the first substrate 2, and an insulating layer 8 and cathode electrodes 6' are then formed on the gate electrodes 10'. The gate electrodes 10' and the cathode electrodes 6' proceed perpendicular to each other, and the crossed regions of the gate and the cathode electrodes 10' and 6' are placed at unit pixels 101 defined on the first substrate 2. An electron emission region 12' is on a lateral surface of the cathode electrode 6' in the crossed regions of the two electrodes.

Concave portions 22 may be formed at a lateral surface of the cathode electrode 6', and in one embodiment, the electron emission region 12' is formed on the insulating layer 8 while filling the concave portion 22.

Counter electrodes 24 electrically connected to the gate electrodes 10' are spaced apart from the electron emission regions 12' between the cathode electrodes 6'. The counter electrodes 24 contact the gate electrodes 10' through via holes 82 formed at the insulating layer 8, and pull the electric fields of the gate electrodes 10' over the insulating layer 8, thereby forming strong electric fields around the electron emission regions 12'. The remaining structural components of the electron emission region in this embodiment are similar to those discussed above in relation to FIGS. 1-3. In this embodiment, the cathode electrodes 6' can function as scan electrodes, and the gate electrodes 10' can function as data electrodes for carrying the image data.

Figure 8:
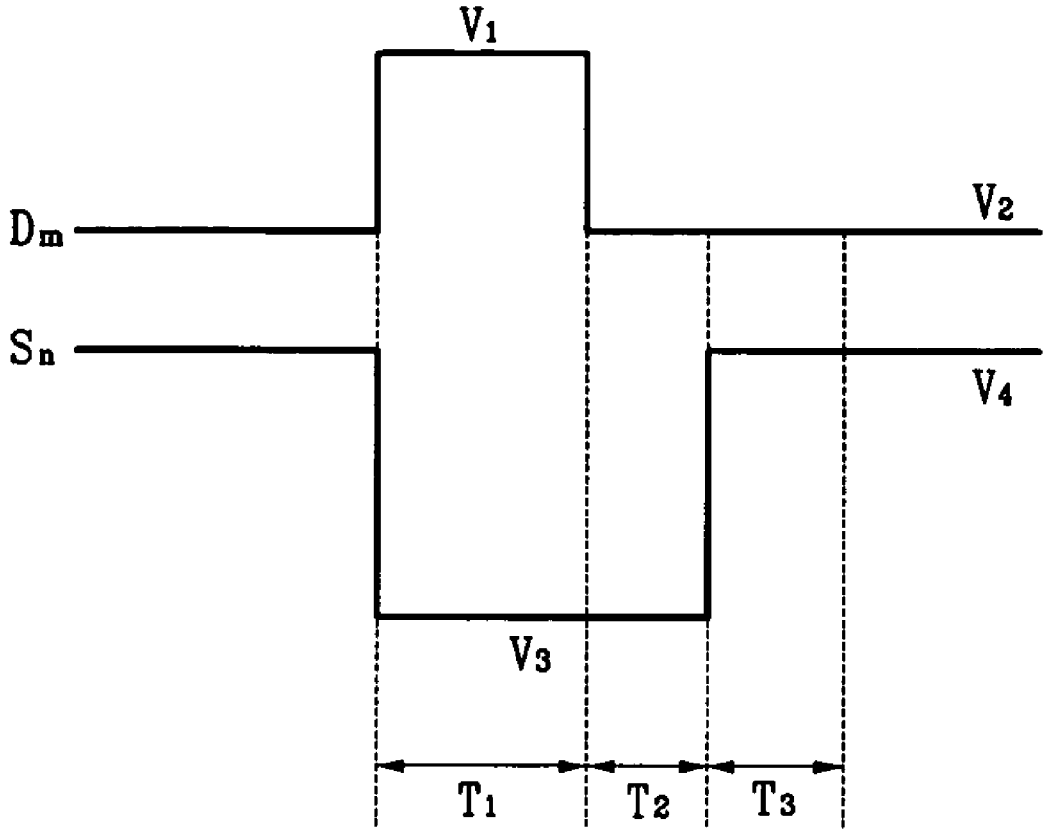
FIG. 8 is a driving waveform diagram illustrating waveforms of scan and data voltages applied in an electron emission device according to an embodiment of the present invention.

FIG. 8 is a driving waveform diagram illustrating the waveforms of scan and data voltages applied in the electron emission device according to the present embodiment. For explanatory convenience, the cathode electrode 6' will be referred to hereinafter as the "scan electrode," and the gate electrode 10' as the "data electrode."

As shown in FIG. 8, a low ON voltage $V_3$ is applied to the scan electrode Sn for a period $T_1$, and a high ON voltage $V_1$ to the data electrode Dm. Then, electrons are emitted from the electron emission regions due to the difference $V_1-V_3$ between the voltages applied to the scan electrode Sn and the data electrode Dm, and the emitted electrons collide against the phosphor layers to cause them to emit light.

Thereafter, an ON voltage $V_3$ of the scan signal is maintained at the scan electrode Sn during the period $T_2$, and a low OFF voltage $V_2$ is applied to the data electrode Dm. Then, the difference $V_3-V_2$ between the voltages applied to the scan electrode Sn and the data electrode Dm is reduced, and hence, the electrons are not emitted from the electron emission regions. The time interval $T_1$ during which the data pulse is maintained may be varied to thereby express the desired gray scales.

An OFF voltage $V_4$ of the scan signal is applied to the scan electrode Sn within the period $T_3$, and an OFF voltage $V_2$ of the data signal is maintained at the data electrode Dm. Therefore, electrons are not emitted from the electron emission regions. The OFF voltage $V_4$ of the scan signal is established to be the same as the OFF voltage $V_2$ of the data signal, which is commonly 0V. The ON voltage $V_3$ of the scan signal may be established to be in the range of −50~−80V, and the ON voltage $V_1$ of the data signal may be established to be in the range of 40~70V.

In this embodiment, the scan electrodes are arranged along the long axis of the first and the second substrates 2 and 4 (in the direction of the x axis of the drawing). The scan electrodes are formed with a metallic layer having a specific resistance of 0.1~100 Ωcm and a thickness of 0.1~0.3 μm such that the internal resistance thereof can be reduced.

Referring to FIG. 7, the scan electrode 6' satisfies the following condition (Formula 2):

$$0.5 \leqq Sv'/Pv' \leqq 0.95,$$

where the width of the scan electrode 6' (measured outside of an area with a concave portion 22) is indicated by Sv', and the vertical pitch of the unit pixels 101 measured along the width of the scan electrode 6' (in the direction of the y axis of the drawing) is indicated by Pv', Electron emission devices were fabricated according to several Examples (Ex.) where the value of Sv'/Pv' satisfied the condition of Formula 2, and Comparative Examples (Com. Ex.) where the value of Sv'/Pv' deviated from the condition of Formula 2. For each of the Examples and Comparative Examples, the electron emission devices were driven and damage to the scan electrodes was observed. The results are listed in Table 2, below.

With all of the Examples and Comparative Examples tested, the vertical pitch Pv of the unit pixel was 632 μm, and the degree of breakage of the scan electrodes was observed after normal driving voltage had been applied to the scan electrodes and the data electrodes for five (5) hours. The degree of damage to the scan electrodes are indicated by ◎, ○, Δ, and X in sequence from the lowest to the highest degree of damage.

TABLE 2

| | Com. Ex. 1 | Com. Ex. 2 | Com. Ex. 3 | Com. Ex. 4 | Ex. 1 | Ex. 2 | Ex. 3 | Ex. 4 |
|---|---|---|---|---|---|---|---|---|
| Sv' (μm) | 150 | 200 | 250 | 300 | 350 | 400 | 500 | 600 |
| Sv'/Pv' | 0.237 | 0.316 | 0.400 | 0.475 | 0.554 | 0.632 | 0.791 | 0.949 |
| Damage to scan electrode | X | X | X | Δ | ○ | ○ | ◎ | ◎ |

As listed in Table 2, in the electron emission devices according to the Comparative Examples, where the ratio of the width Sv' of the scan electrode to the vertical pitch Pv' of the unit pixel was less than 0.5, the heat generated at the scan electrode was increased, and the scan electrode was seriously damaged. In contrast, in the electron emission devices according to the Examples, where the ratio of the width Sv' of the scan electrode to the vertical pitch Pv' of the unit pixel was 0.5 or more, the heat generated at the scan electrode was reduced, and hence, the scan electrode had little damage.

Moreover, in the electron emission devices according to the Examples 3 and 4, where the ratio of the width Sv' of the scan electrode to the vertical pitch Pv' of the unit pixel exceeded 0.79, the scan electrode showed the least damage. Accordingly, the ratio of the width Sv' of the scan electrode to the vertical pitch Pv' of the unit pixel in some embodiments of the invention is established to be in the range of 0.79~0.95.

Like the embodiment described in relation to FIGS. 1-3, the above results are due to the line width of the scan electrode becoming enlarged so that its internal resistance decreased, thereby reducing the heat generated at the scan electrode. The ratio of Sv'/Pv' in one embodiment is also established to be 0.95 or less such that the driving interference between the unit pixels as well as the generation of electrical shorts between the neighboring scan electrodes can be prevented.

When the area of the unit pixel, and the area of the scan electrode within the unit pixel are compared with each other based on the ratio of Sv'/Pv', the area of the scan electrode within the unit pixel in some embodiments is established to be 50% or more of the area of the unit pixel.

In the embodiments described above, the line width of the scan electrode may be optimized to effectively reduce the heat generated at the scan electrode without distorting the scan voltage pulse. Consequently, such an inventive electron emission device prevents the electrodes from being broken due to the elevation of temperature, thereby increasing the life span and durability thereof, and enhancing the display quality.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

a first substrate;

a second substrate facing the first substrate;

a scan electrode on the first substrate and having a width Sv;

a data electrode on the first substrate perpendicular to and crossing the scan electrode at a crossed region;

a unit pixel in an area of the crossed region and having a pitch Pv;

an insulating layer between the scan electrode and the data electrode; and an electron emission region electrically coupled to the scan electrode or the data electrode, wherein the scan electrode and the unit pixel satisfy the following condition: $0.5 \leqq Sv/Pv \leqq 0.95$, and wherein the scan electrode is arranged along a long axis of the first substrate and the second substrate, and the pitch of the unit pixel is a vertical pitch measured in a direction of the width of the scan electrode.

2. The electron emission device of claim 1, wherein the scan electrode and the unit pixel satisfy the following condition: $0.79 \leqq Sv/Pv \leqq 0.95$.

3. The electron emission device of claim 1, wherein an area of the scan electrode within the unit pixel is 50% or more of an area of the unit pixel.

4. The electron emission device of claim 1, wherein the data electrode, the insulating layer and the scan electrode are sequentially formed on the first substrate, and the electron emission region is electrically coupled to the data electrode.

5. The electron emission device of claim 1, wherein the data electrode, the insulating layer and the scan electrode are sequentially formed on the first substrate, and the electron emission region is electrically coupled to the scan electrode.

6. The electron emission device of claim 5, wherein the electron emission region contacts a lateral surface of the scan electrode, and is located on the insulating layer.

7. The electron emission device of claim 1, wherein the electron emission region comprises at least one material selected from the group consisting of carbon nanotube, graphite, graphite nanofiber, diamond, diamond-like carbon, $C_{60}$ and silicon nanowire.

8. An electron emission device comprising:

a first substrate;

a second substrate facing the first substrate;

a scan electrode on the first substrate and having a width Sv;

a data electrode on the first substrate perpendicular to and crossing the scan electrode at a crossed region;

a unit pixel in an area of the crossed region and having a pitch Pv;

an insulating layer between the scan electrode and the data electrode; and an electron emission region electrically coupled to the scan electrode or the data electrode, wherein the scan electrode and the unit pixel satisfy the following condition: $0.5 \leqq Sv/Pv \leqq 0.95$, wherein the data electrode, the insulating layer and the scan electrode are sequentially formed on the first substrate, and the electron emission region is electrically coupled to the data electrode, and wherein at least one opening is formed in the scan electrode and in the insulating layer at the crossed region, and the electron emission region is formed on the data electrode within the at least one opening.

9. An electron emission device comprising:

a first substrate;

a second substrate facing the first substrate;

a scan electrode on the first substrate and having a width Sv;

a data electrode on the first substrate perpendicular to and crossing the scan electrode at a crossed region;

a unit pixel in an area of the crossed region and having a pitch Pv;

an insulating layer between the scan electrode and the data electrode;

an electron emission region electrically coupled to the scan electrode or the data electrode; and a counter electrode spaced apart from the electron emission region, the counter electrode electrically coupled to the data electrode, wherein the scan electrode and the unit pixel satisfy the following condition: $0.5 \leqq Sv/Pv \leqq 0.95$, and wherein the data electrode, the insulating layer and the scan electrode are sequentially formed on the first substrate, and the electron emission region is electrically coupled to the scan electrode.

10. An electron emission device comprising:

a first substrate;

a second substrate facing the first substrate;

a scan electrode on the first substrate and having a width Sv;

a data electrode on the first substrate perpendicular to and crossing the scan electrode at a crossed region;

a unit pixel in an area of the crossed region and having a pitch Pv;

an insulating layer between the scan electrode and the data electrode; and an electron emission region electrically coupled to the scan electrode or the data electrode, wherein the scan electrode and the unit pixel satisfy the following condition: $0.5 \leqq Sv/Pv \leqq 0.95$, and wherein the scan electrode comprises a metallic layer having a thickness of about 0.1~0.3 μm.

11. An electron emission device comprising:

a first substrate;

a second substrate facing the first substrate;

a scan electrode on the first substrate and having a width Sv;

a data electrode on the first substrate perpendicular to and crossing the scan electrode at a crossed region;

a unit pixel in an area of the crossed region and having a pitch Pv;

an insulating layer between the scan electrode and the data electrode; and an electron emission region electrically coupled to the scan electrode or the data electrode, wherein the scan electrode and the unit pixel satisfy the following condition: $0.5 \leqq Sv/Pv \leqq 0.95$, and wherein the scan electrode comprises a metallic layer having a specific resistance of about 0.1~100 Ωcm.

* * * * *